US010593271B1

(12) United States Patent
Chen

(10) Patent No.: US 10,593,271 B1
(45) Date of Patent: Mar. 17, 2020

(54) MICRO LIGHT-EMITTING DIODE DRIVING CIRCUIT AND DISPLAY USING THE SAME

(71) Applicant: MIKRO MESA TECHNOLOGY CO., LTD., Apia (WS)

(72) Inventor: Li-Yi Chen, Tainan (TW)

(73) Assignee: MIKRO MESA TECHNOLOGY CO., LTD., Apia, Samoa ( * ) Notice: Subject to any disclaimer, the term of this patent is extended or adjusted under 35 U.S.C. 154(b) by 0 days.

(21) Appl. No.: 16/243,100

(22) Filed: Jan. 9, 2019

(51) Int. Cl.

| | |
|---|---|
| ***H05B 33/00*** | (2006.01) |
| ***G09G 3/34*** | (2006.01) |
| ***G09G 3/32*** | (2016.01) |
| ***H05B 33/08*** | (2020.01) |

(52) U.S. Cl.
CPC ..... *G09G 3/3406* (2013.01); *G09G 3/32* (2013.01); *H05B 33/0824* (2013.01); *G09G 2320/0626* (2013.01)

(58) Field of Classification Search
CPC ..... H01L 27/3265; H01L 27/124; H01L 27/1255; H01L 27/32; H01L 27/3211; H01L 27/3216; H01L 27/3248; H01L 27/3276; H01L 27/3288; H01L 2224/16148; H01L 24/16; H01L 25/162; H01L 25/167; H01L 25/18; H01L 27/1214; H01L 27/156; H01L 2924/12041; H01L 2924/1426; H01L 27/1225; H01L 27/3262; H01L 27/3274; H01L 29/24; H01L 29/66969; H01L 29/7869; H01L 29/78696; H01L 51/5012; H04L 2001/125; H04L 2209/56; H04L 2209/80; H04L 5/0044; H04L 9/0822; H04L 9/0872
See application file for complete search history.

(56) References Cited

U.S. PATENT DOCUMENTS

2015/0371585 A1* 12/2015 Bower ..... G09G 3/32 345/1.1
2019/0164498 A1* 5/2019 Jang ..... G09G 3/3266

* cited by examiner

*Primary Examiner* — Monica C King
(74) *Attorney, Agent, or Firm* — McClure, Qualey & Rodack, LLP

(57) ABSTRACT

A micro light-emitting diode driving circuit including a micro light-emitting diode, a first driving transistor, and a second driving transistor is provided. The first driving transistor receives a first driving voltage from a first driving voltage source, and is electrically connected to the micro light-emitting diode and a low voltage source. The second driving transistor receives a second driving voltage from a second driving voltage source, and is electrically connected to the micro light-emitting diode and a low voltage source. One terminal of the first driving transistor and one terminal of the second driving transistor are electrically and separately connected to one end of the micro light-emitting diode, and a lateral length of the micro light-emitting diode is less than or equal to 50 μm.

15 Claims, 8 Drawing Sheets

MICRO LIGHT-EMITTING DIODE DRIVING CIRCUIT AND DISPLAY USING THE SAME

BACKGROUND

Field of Invention

The present disclosure relates to a micro light-emitting diode driving circuit which enables a high dynamic range display.

Description of Related Art

The statements in this section merely provide background information related to the present disclosure and do not necessarily constitute prior art.

In recent years, micro devices have become popular in various applications. One of the promising subfield is micro light-emitting diode devices, and one of the important issues of said subfield is contrast of images or videos shown by a micro light-emitting diodes display.

SUMMARY

According to some embodiments of the present disclosure, a micro light-emitting diode driving circuit including a micro light-emitting diode, a first driving transistor, and a second driving transistor is provided. The first driving transistor is configured to receive a first driving voltage from a first driving voltage source, and is electrically connected to the micro light-emitting diode and a low voltage source. The second driving transistor is configured to receive a second driving voltage from a second driving voltage source, and is electrically connected to the micro light-emitting diode and a low voltage source. One terminal of the first driving transistor and one terminal of the second driving transistor are electrically and separately connected to one end of the micro light-emitting diode, and a lateral length of the micro light-emitting diode is less than or equal to 50 μm.

According to some embodiments of the present disclosure, a micro light-emitting diode display including a substrate and a plurality of micro light-emitting diode driving circuits are provided. The plurality of micro light-emitting diode driving circuits are present on the substrate.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1A:
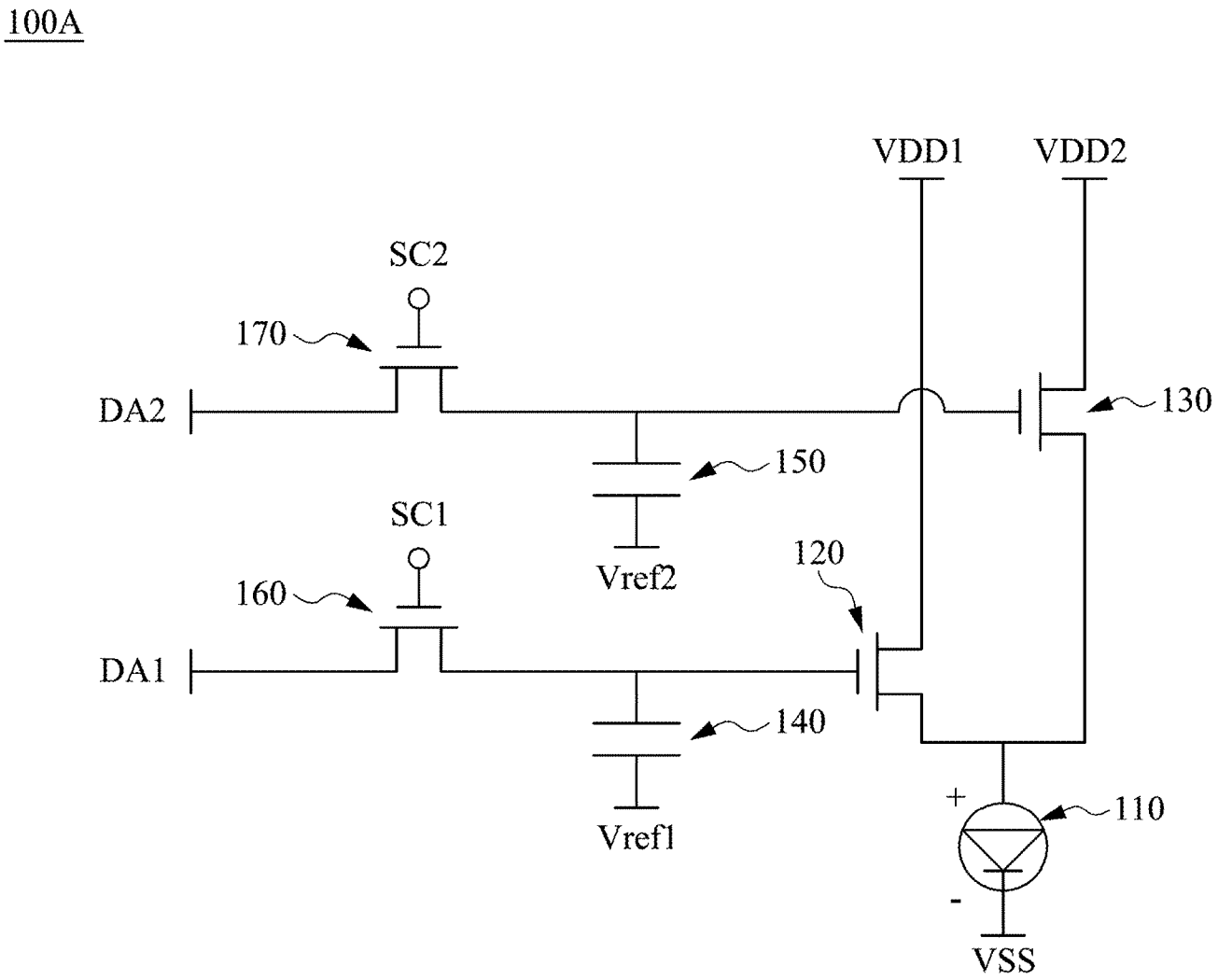
FIG. 1A is a schematic diagram of a micro light-emitting diode driving circuit in some embodiments of the present disclosure.

Reference will now be made in detail to the present embodiments of the disclosure, examples of which are illustrated in the accompanying drawings. Wherever possible, the same reference numbers are used in the drawings and the description to refer to the same or like parts.

In various embodiments, description is made with reference to figures. However, certain embodiments may be practiced without one or more of these specific details, or in combination with other known methods and configurations. In the following description, numerous specific details are set forth, such as specific configurations, dimensions and processes, etc., in order to provide a thorough understanding of the present disclosure. In other instances, well-known semiconductor processes and manufacturing techniques have not been described in particular detail in order to not unnecessarily obscure the present disclosure. Reference throughout this specification to "one embodiment," "an embodiment", "some embodiments" or the like means that a particular feature, structure, configuration, or characteristic described in connection with the embodiment is included in at least one embodiment of the disclosure. Thus, the appearances of the phrase "in one embodiment," "in an embodiment", "in some embodiments" or the like in various places throughout this specification are not necessarily referring to the same embodiment of the disclosure. Furthermore, the particular features, structures, configurations, or characteristics may be combined in any suitable manner in one or more embodiments.

The terms "over," "to," "between" and "on" as used herein may refer to a relative position of one layer with respect to other layers. One layer "over" or "on" another layer or bonded "to" another layer may be directly in contact with the other layer or may have one or more intervening layers. One layer "between" layers may be directly in contact with the layers or may have one or more intervening layers.

Although most of terms described in the following disclosure use singular nouns, said terms may also be plural in accordance with figures or practical applications.

Figure 1B:
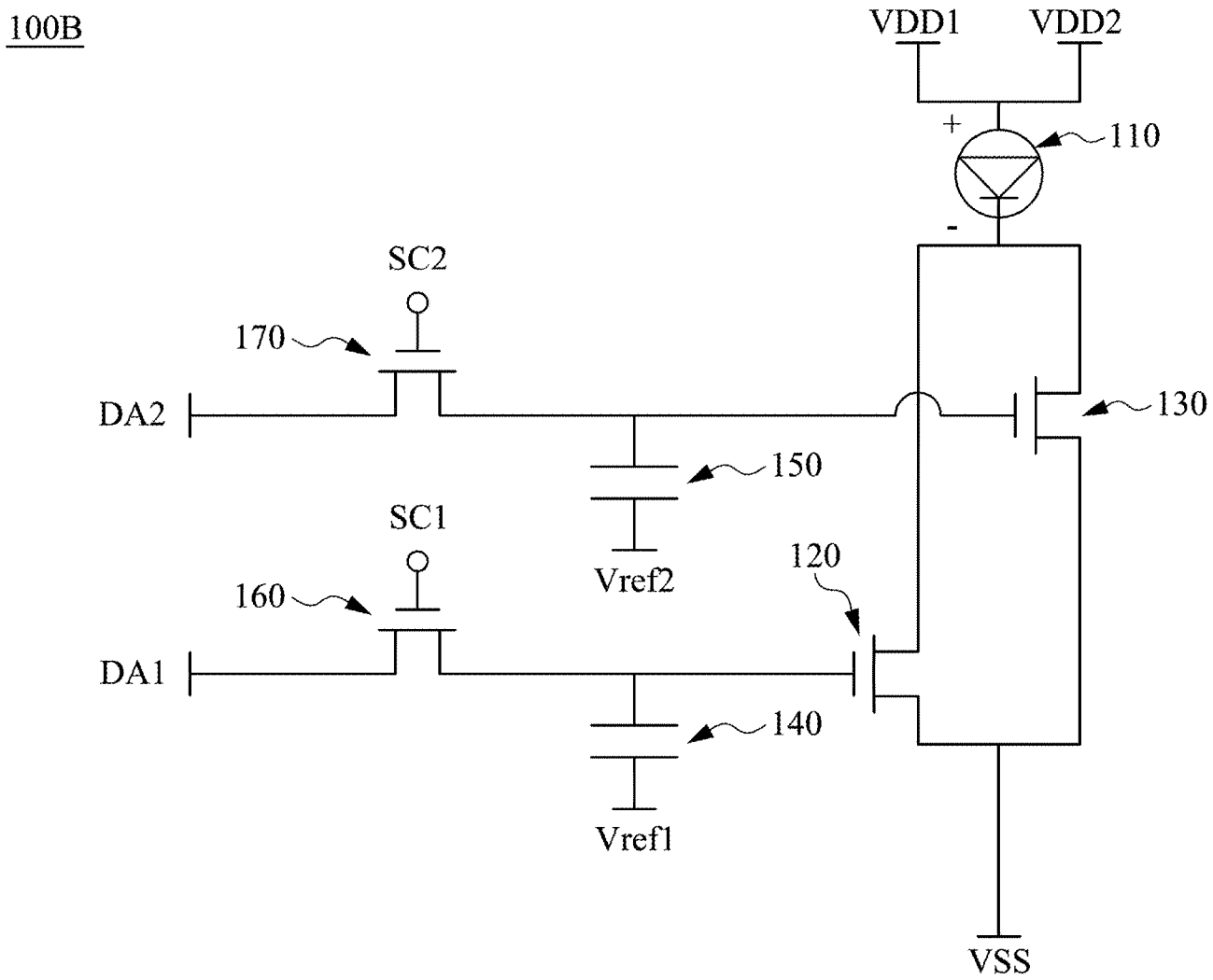
FIG. 1B is a schematic diagram of a micro light-emitting diode driving circuit in some embodiments of the present disclosure.

Reference is made to FIGS. 1A and 1B. FIG. 1A is a schematic diagram of a micro light-emitting diode driving circuit 100A in some embodiments of the present disclosure. FIG. 1B is a schematic diagram of a micro light-emitting diode driving circuit 100B in some embodiments of the present disclosure. In some embodiments, each of the micro light-emitting diode driving circuits 100A, 100B includes a micro light-emitting diode 110, a first driving transistor 120, and a second driving transistor 130. Each of the first driving transistor 120 and the second driving transistor 130 has a gate terminal, a drain terminal, and a source terminal. The micro light-emitting diode 110 has an anode and a cathode. The first driving transistor 120 receives a first driving voltage from a first driving voltage source VDD1. The first driving transistor 120 is electrically connected to the micro light-emitting diode 110. The first driving transistor 120 is electrically connected to a low voltage source VSS. The second driving transistor 130 receives a second driving voltage from a second driving voltage source VDD2. The second driving transistor 130 is electrically connected to the micro light-emitting diode 110 and the low voltage source VSS. In addition, one terminal (e.g., the source terminal or the drain terminal) of the first driving transistor 120 and one terminal (e.g., the source terminal or the drain terminal) of the second driving transistor 130 are electrically and separately connected to one end of the micro light-emitting diode. In other words, the first driving transistor 120 and the second driving transistor 130 are electrically arranged in parallel to each other with respect to one end (e.g, the anode or the cathode) of the micro light-emitting diode 110. A lateral length of the micro light-emitting diode 110 is less than or equal to 50 μm. It is important to note that the first driving transistor 120 is not connected to the micro light-emitting diode 110 via the second driving transistor 130, nor is the second driving transistor 130 connected to the micro light-emitting diode 110 via the first driving transistor 120. That is, the first driving transistor 120 is connected to the micro light-emitting diode 110 directly or via another element that is different from the second driving transistor 130, and the second driving transistor 130 is connected to the micro light-emitting diode 110 directly or via another element that is different from the first driving transistor 120. With the above configuration, a high dynamic range display can be realized. Specifically, for a relatively dark image or a portion of relatively dark pixels, one can turn on only the first driving transistor 120 to drive the micro light-emitting diode 110. For a relatively bright images or a portion of relatively bright pixels, one can turn on both the first driving transistor 120 and the second driving transistor 130 to drive the micro light-emitting diode 110. Each of the pixels described herein is assumed to have the same micro light-emitting diode driving circuit (e.g., the micro light-emitting diode driving circuit 100A or 100B), but should not be limited thereto in practical applications. It should be noted that, although the embodiments in the present disclosure only demonstrate two driving transistors, a number of driving transistors more than two shall not depart from the scope of the present disclosure. For example, there may be three driving transistors, and each of the three driving transistors has one terminal (e.g., source or drain) electrically and separately connected to one end of the micro light-emitting diode 110. In other words, these three driving transistors are electrically arranged in parallel to each other with respect to one end (e.g., anode or cathode) of the micro light-emitting diode 110 to drive the micro light-emitting diode 110, so that three currents respectively flowing through the three driving transistors can converged and flow through the micro light-emitting diode 110.

In some embodiments as illustrated by FIG. 1A, the drain terminals of the first driving transistor 120 and the second driving transistor 130 are respectively connected to the first driving voltage source VDD1 and the second driving voltage source VDD2. The source terminals of the first driving transistor 120 and the second driving transistor 130 are connected to the anode of the micro light-emitting diode 110. The cathode of the micro light-emitting diode 110 is connected to the low voltage source VSS. The low voltage source VSS can be grounded, but should not limited thereto. In some other embodiments as illustrated by FIG. 1B, the drain terminals of the first driving transistor 120 and the second driving transistor 130 are connected to the cathode of the micro light-emitting diode 110. The source terminals of the first driving transistor 120 and the second driving transistor 130 are connected to the low voltage source VSS. The anode of the micro light-emitting diode 110 is connected to the first driving voltage source VDD1 and the second driving voltage source VDD2.

In some embodiments, each of the micro light-emitting diode driving circuits 100A, 100B may further include a first storage capacitor 140 and a second storage capacitor 150. Each of the first storage capacitor 140 and the second storage capacitor 150 has two ends. One of the two ends of the first storage capacitor 140 is connected to the gate terminal of the first driving transistor 120. The other end of the first storage capacitor 140 is connected to a first reference voltage Vref1. One of the two ends of the second storage capacitor 150 is connected to the gate terminal of the second driving transistor 130. The other end of the second storage capacitor 150 is connected to a second reference voltage Vref2. The storage capacitors 140, 150 are used to keep voltages of the gate terminals of the driving transistors 120, 130 respectively until next voltages (e.g., next frame) are applied. In some embodiments, said the other end of the first storage capacitor 140 can also be connected to the source terminal of the first driving transistor 120. In some embodiments, said the other end of the second storage capacitor 150 can also be connected to the source terminal of the second driving transistor 130.

In some embodiments, each of the micro light-emitting diode driving circuits 100A, 100B may further include a first switching transistor 160 and a second switching transistor 170. The first switching transistor 160 has a gate terminal, a drain terminal, and a source terminal. The gate terminal of the first switching transistor 160 is connected to a first scan line SC1. The drain terminal of the first switching transistor 160 is connected to a first data line DA1. The source terminal of the first switching transistor 160 is connected to the gate terminal of the first driving transistor 120 and one end of the first storage capacitor 140, in which said end is also connected to the gate terminal of the first driving transistor 120. The second switching transistor 170 has a gate terminal, a drain terminal, and a source terminal. The gate terminal of the second switching transistor 170 is connected to a second scan line SC2. The drain terminal of the second switching transistor 170 is connected to a second data line DA2. The source terminal of the second switching transistor 170 is connected to the gate terminal of the second driving transistor 130 and one end of the second storage capacitor 150, in which said end is also connected to the gate terminal of the second driving transistor 130. The scan lines SC1, SC2 control a renewal of an image. The data lines DA1, DA2 respectively determine a gate voltage of the first driving transistor 120 and a gate voltage of the second driving transistor 130. Furthermore, a combination of the first data line DA1 and the first driving voltage source VDD1 and a combination of the second data line DA2 and the second driving voltage source VDD2 jointly determine a brightness of the micro light-emitting diode 110. The switching transistors 160, 170 are used as a switch respectively to determine if the driving transistors 120, 130 are allowed to apply currents for the micro light-emitting diode 110.

Figure 2:
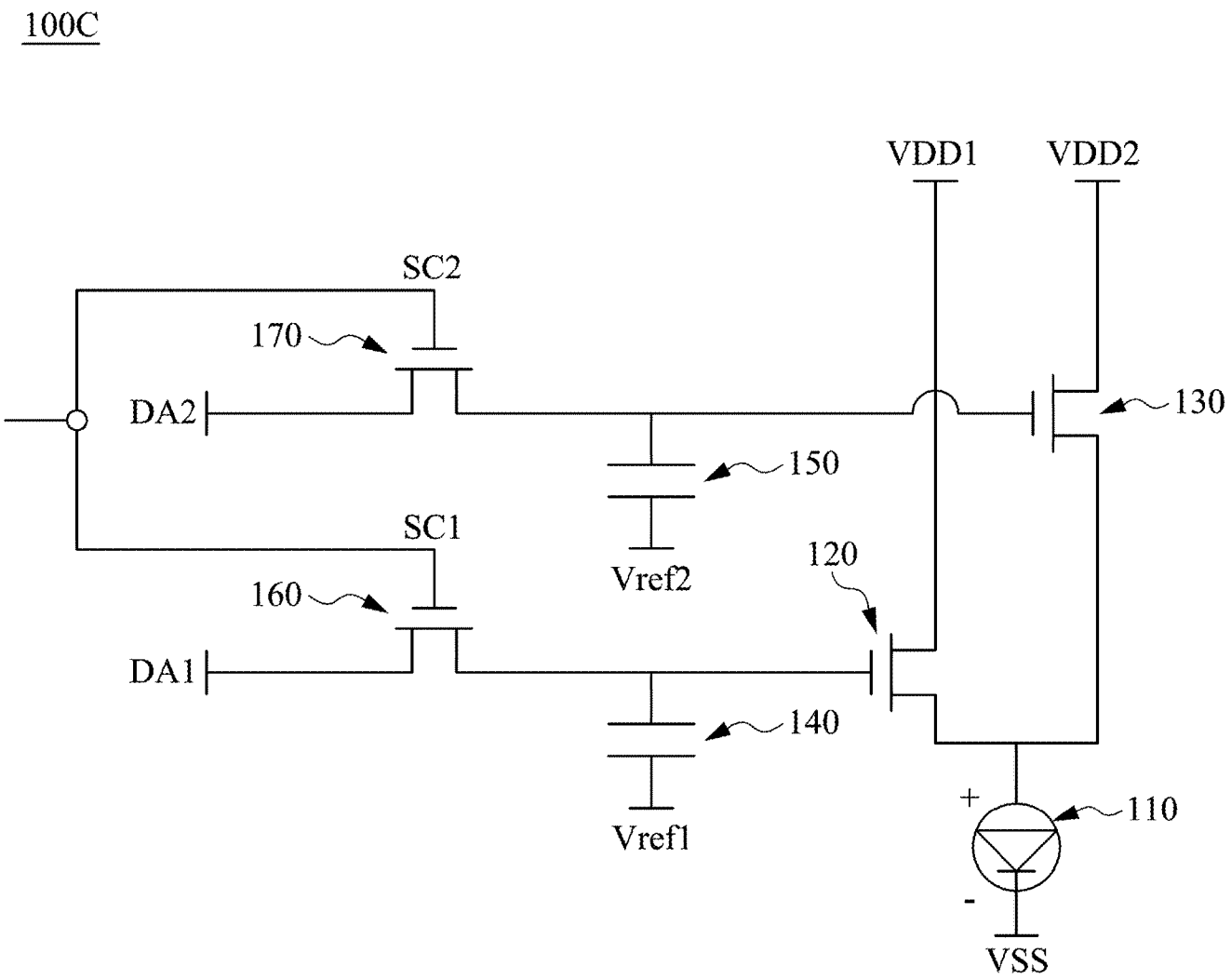
FIG. 2 is a schematic diagram of a micro light-emitting diode driving circuit in some embodiments of the present disclosure.

Reference is made to FIG. 2. FIG. 2 is a schematic diagram of a micro light-emitting diode driving circuit 100C in some embodiments of the present disclosure. The micro light-emitting diode driving circuit 100C is similar to the micro light-emitting diode driving circuit 100A, except that the first scan line SC1 and the second scan line SC2 are connected to a junction in the embodiments illustrated by FIG. 2, while the first scan line SC1 and the second scan line SC2 are separated from each other in the embodiments illustrated by FIG. 1A. Therefore, the first scan line SC1 and the second scan line SC2 can be the same scan line, so as to simplify a circuit layout.

Figure 3:
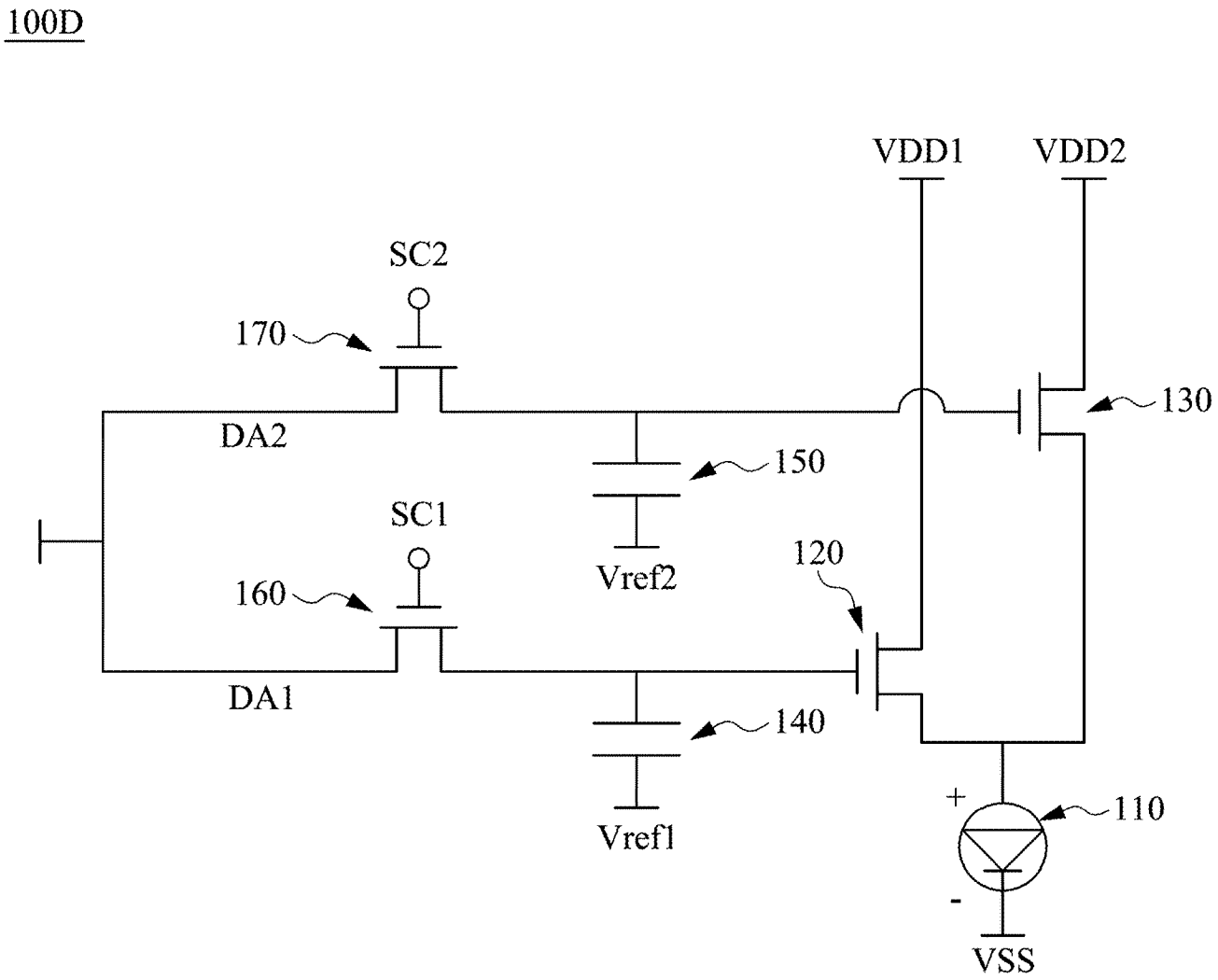
FIG. 3 is a schematic diagram of a micro light-emitting diode driving circuit in some embodiments of the present disclosure.

Reference is made to FIG. 3. FIG. 3 is a schematic diagram of a micro light-emitting diode driving circuit 100D in some embodiments of the present disclosure. The micro light-emitting diode driving circuit 100D is similar to the micro light-emitting diode driving circuit 100A, except that the first data line DA1 and the second data line DA2 are connected to a junction in the embodiments illustrated by FIG. 3, while the first data line DA1 and the second data line DA2 are separated from each other in the embodiments illustrated by FIG. 1A. Therefore, the first data line DA1 and the second data line DA2 can be the same data line, so as to simplify a circuit layout.

Figure 4:
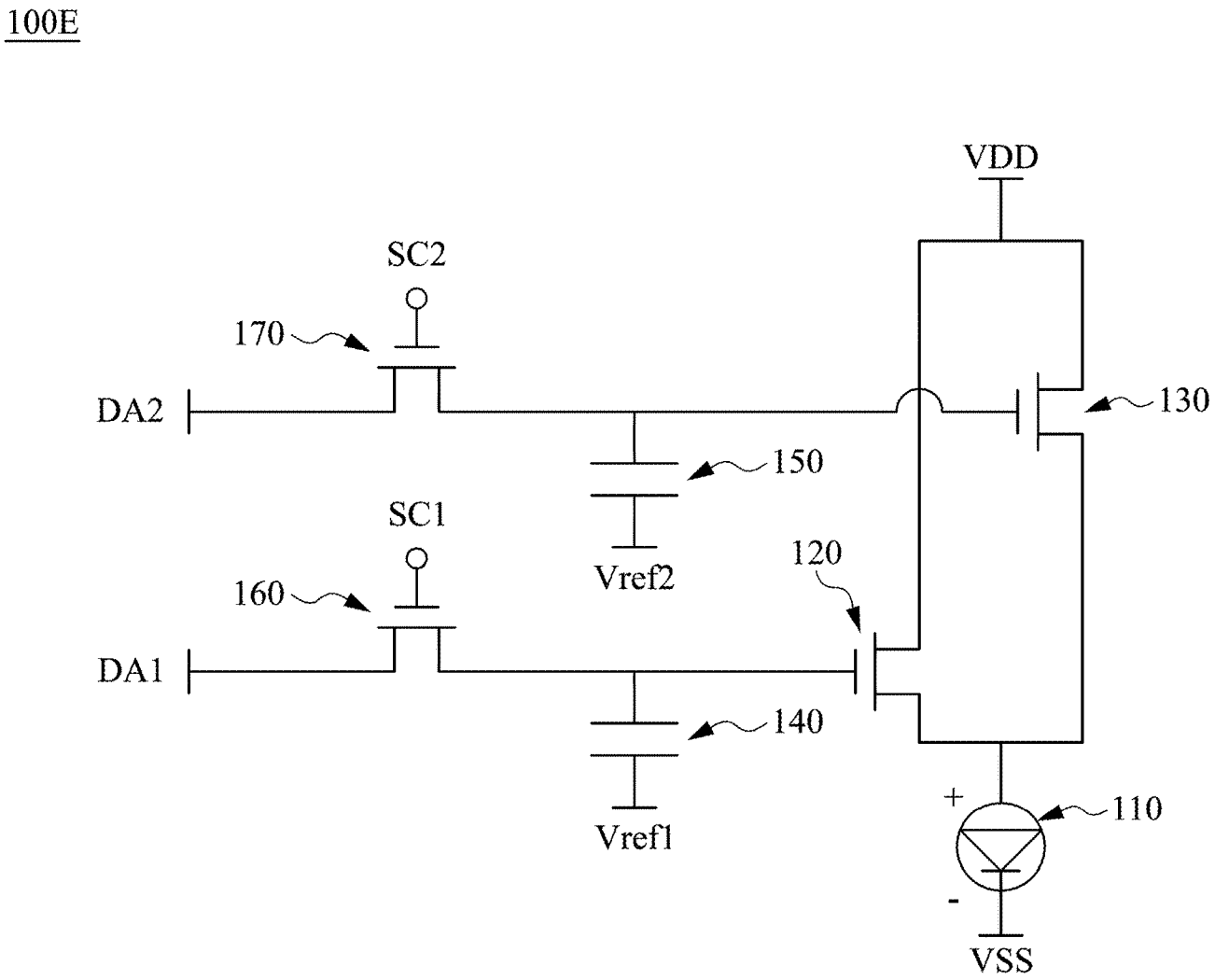
FIG. 4 is a schematic diagram of a micro light-emitting diode driving circuit in some embodiments of the present disclosure.

Reference is made to FIG. 4. FIG. 4 is a schematic diagram of a micro light-emitting diode driving circuit 100E in some embodiments of the present disclosure. The micro light-emitting diode driving circuit 100E is similar to the micro light-emitting diode driving circuit 100A, except that a common driving voltage source VDD is used in the embodiments illustrated by FIG. 4 (i.e. the first driving voltage source VDD1 and the second driving voltage source VDD2 in FIG. 1A become the same driving voltage source), while the first driving voltage source VDD1 and the second driving voltage source VDD2 are separated from each other in the embodiments illustrated by FIG. 1A. Therefore, the first driving voltage source VDD1 and the second driving voltage source VDD2 can be the same driving voltage source, so as to simplify a circuit layout.

Figure 5A:
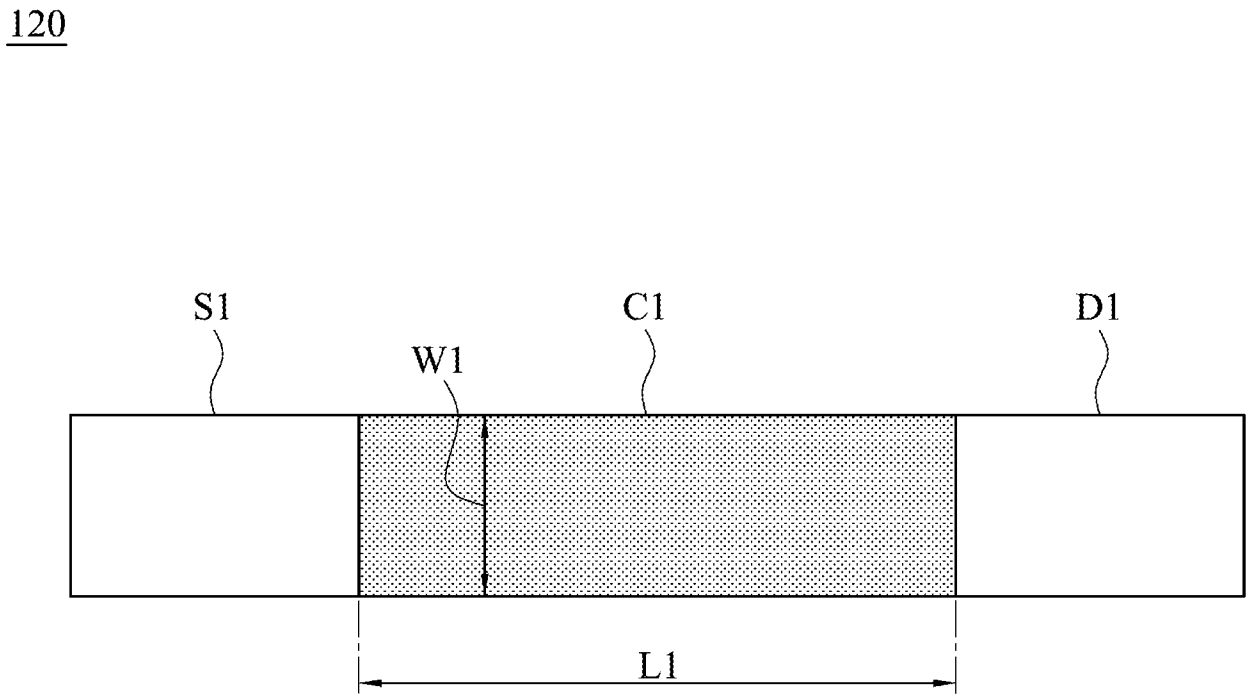
FIG. 5A is a schematic top view of a first driving transistor according to some embodiments of the present disclosure.
Figure 5B:
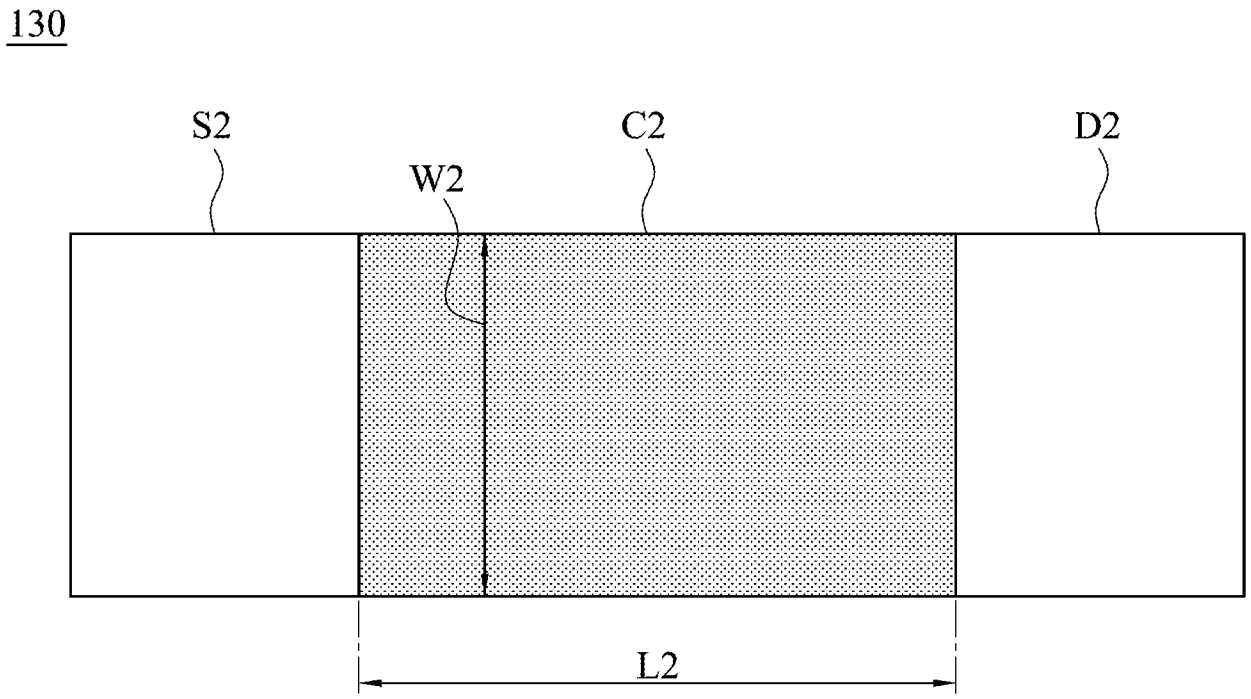
FIG. 5B is a schematic top view of a second driving transistor according to some embodiments of the present disclosure.

Reference is made to FIGS. 5A, 5B, and 1A. FIG. 5A is a schematic top view of the first driving transistor 120 of according to some embodiments of the present disclosure. FIG. 5B is a schematic top view of the second driving transistor 130 of according to some embodiments of the present disclosure. In some embodiments, a ratio of a channel width W2 to a channel length L2 of the second driving transistor 130 is greater than a ratio of a channel width W1 to a channel length L1 of the first driving transistor 120. A source S1, a drain D1, and a channel C1 (e.g., a semiconductor layer) of the first driving transistor 120 and a source S2, a drain D2, and a channel C2 (e.g., a semiconductor layer) of the second driving transistor 130 are schematically shown in FIGS. 5A and 5B respectively. Since a higher width-to-length ratio of a channel can increase a current gain and subsequently has a higher current for a given gate voltage, the second driving transistor 130 can be a transistor which is normally off and is particularly used in a case with an extremely high contrast or high brightness, such as an image with localized sunshine. In such high brightness pixels, the first driving transistor 120 can be off or on. Therefore, a high dynamic range display can be realized while a lifetime of driving transistors 120, 130 can be maintained. The lifetime of the first driving transistor 120 can be longer since there is no need to apply high gate voltages to the first driving transistor 120 in the above parallel arrangement (i.e., currents flowing through the driving transistors are converged and flow through the micro light-emitting diode 110), so as to prevent lifetime shortening on the first driving transistor 120. In some embodiments, said ratio of the channel width W2 to the channel length L2 of the second driving transistor 130 is at least twice greater than said ratio of the channel width W1 to the channel length L1 of the first driving transistor 120.

In some embodiments, a ratio of a channel width W2 to a channel length L2 of the second driving transistor 130 is the same as a ratio of a channel width W1 to a channel length L1 of the first driving transistor 120. In these embodiments, the dynamic range can also be high due to two parallel transistors as current sources for the micro light-emitting diode 110. Either one of the first driving transistor 120 and the second driving transistor 130 is on, or both of the first driving transistor 120 and the second driving transistor 130 are on.

As a further explanation and a comparison, a conventional thin film transistor liquid crystal display (TFT-LCD) has a maximum brightness about 500 nits. However, it is not enough for a case such as an image having a sunrise therein, which needs locally 3000 nits or even 10000 nits. The embodiments of the present disclosure, with the first driving transistor 120 and the second driving transistor 130 electrically arranged in parallel to each other with respect to the micro light-emitting diode 110 so that currents respectively flowing through the first driving transistor 120 and the second driving transistor 130 are summed up to flow through the micro light-emitting diode 110, and with the micro light-emitting diode 110 having a lateral length less than or equal to 50 μm, the above insufficiency of the conventional TFT-LCD can be solved. The use of the micro light-emitting diode 110 is important since a range of currents it can bear is larger than other light emitting elements, (e.g., organic light-emitting diode), so that it can have a high dynamic range of illumination with the help of said parallel arrangement of the driving transistors. It should be noted that, the first driving transistor 120 and the second driving transistor 130 with stripe type channels (e.g., the channel C1 and the channel C2) as shown in FIGS. 5A and 5B respectively are just exemplifications. The first driving transistor 120 and/or the second driving transistor 130 having other shapes, such as a circular shape or an octagonal shape are also within the scope of the present disclosure.

It should be noted that, FIGS. 5A and 5B do not show all elements of the first driving transistor 120 and the second driving transistor 130, and the main purpose of FIGS. 5A and 5B is to show geometry of contacts between sources S1, S2 and channels C1, C2 respectively, or between drains D1, D2 and channels C1, C2 respectively. Therefore, some elements, such as a gate, oxide layers, or electrodes connecting the source/drain to other circuit elements are omitted, so that features of said contacts to be revealed in FIGS. 5A and 5B are more clear.

Figure 6:
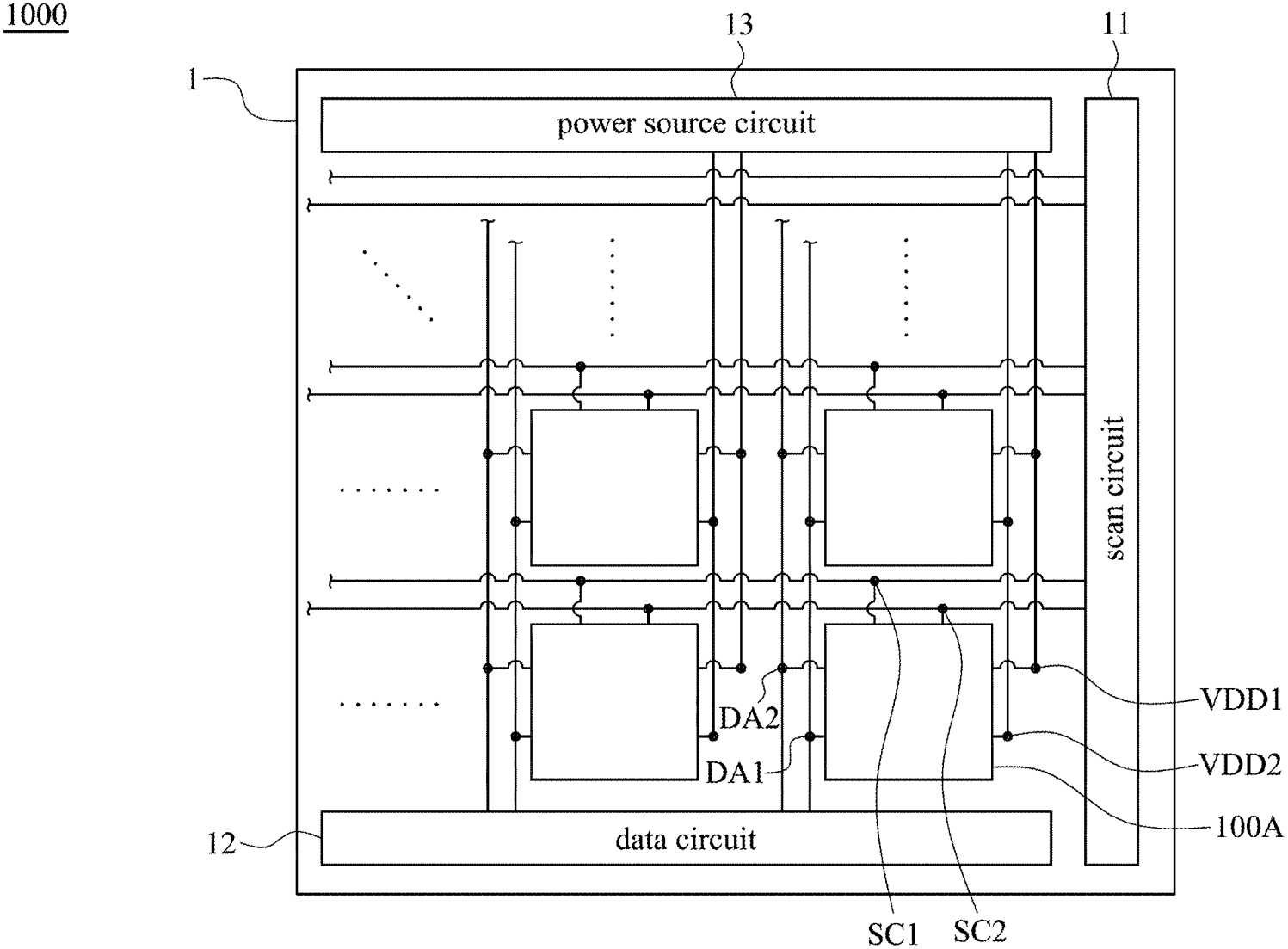
FIG. 6 is a schematic top view of a micro light-emitting diode display according to some embodiments of the present disclosure.

Reference is made to FIG. 6 and FIGS. 1A, 1B, 2, 3, and 4. FIG. 6 is a schematic top view of a micro light-emitting diode display 1000 according to some embodiments of the present disclosure. In some embodiments, the micro light-emitting diode display 1000 includes a substrate 1 and a plurality of micro light-emitting diode driving circuits. Although FIG. 6 only indicates the micro light-emitting diode driving circuit 100A, it is only for an exemplification. Other kinds of micro light-emitting diode driving circuits (e.g., the micro light-emitting diode driving circuits 1006, 100C, 100D, 100E, a combination thereof, or the like) can be present in embodiments as illustrated by FIG. 6, and should not be limited thereto. Each of blocks in FIG. 6 represents a micro light-emitting diode driving circuit, or equivalently, one pixel. The micro light-emitting diode driving circuits are present on the substrate 1. The micro light-emitting diode display 1000 can further include a scan circuit 11, a data circuit 12, and a power source circuit 13. The scan circuit 11 is configured to provide scan voltages to scan lines (e.g., the scan line SC1 and the scan line SC2 of the micro light-emitting diode driving circuit 100A, but should not be limited thereto). The data circuit 12 is configured to provide data voltages to data lines (e.g., the data line DA1 and the data line DA2 of the micro light-emitting diode driving circuit 100A, but should not be limited thereto). The power source circuit 13 acts as driving voltage sources to provide driving voltages to the micro light-emitting diode driving circuits. For example, the power source circuit 13 can act as the first driving voltage source VDD1 to provide the first driving voltage to the first driving transistor 120 of the micro light-emitting diode driving circuit 100A, and also act as the second driving voltage source VDD2 to provide the second driving voltage to the second driving transistor 130 of the micro light-emitting diode driving circuit 100A.

In summary, a parallel arrangement of at least two driving transistors for driving a micro light-emitting diode is provided in the embodiments of the present disclosure to realize a high dynamic range display.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A micro light-emitting diode driving circuit in a pixel, comprising:

a micro light-emitting diode;

a first driving transistor configured to receive a first driving voltage from a first driving voltage source, and being electrically connected to the micro light-emitting diode and a low voltage source; and a second driving transistor configured to receive a second driving voltage from a second driving voltage source, and being electrically connected to the micro light-emitting diode and the low voltage source;

wherein one terminal of the first driving transistor and one terminal of the second driving transistor are electrically and separately connected to one end of the micro light-emitting diode, wherein respective source terminals of the first driving transistor and the second driving transistor are directly connected to an anode of the micro light-emitting diode, and a lateral length of the micro light-emitting diode is less than or equal to 50 μm.

2. The micro light-emitting diode driving circuit of claim 1, further comprising:

a first storage capacitor having two ends, wherein one of the two ends of the first storage capacitor is connected to a gate terminal of the first driving transistor, and another of the two ends is connected to a source terminal of the first driving transistor or a first reference voltage; and a second storage capacitor having two ends, wherein one of the two ends of the second storage capacitor is connected to a gate terminal of the second driving transistor, and another of the two ends is connected to a source terminal of the second driving transistor or a second reference voltage.

3. The micro light-emitting diode driving circuit of claim 2, further comprising:

a first switching transistor having a gate terminal connected to a first scan line, a drain terminal connected to a first data line, and a source terminal connected to said one of the two ends of the first storage capacitor and the gate terminal of the first driving transistor; and a second switching transistor having a gate terminal connected to a second scan line, a drain terminal connected to a second data line, and a source terminal connected to said one of the two ends of the second storage capacitor and the gate terminal of the second driving transistor.

4. The micro light-emitting diode driving circuit of claim 3, wherein the first scan line and the second scan line are connected to a junction.

5. The micro light-emitting diode driving circuit of claim 4, wherein the first data line and the second data line are separated from each other.

6. The micro light-emitting diode driving circuit of claim 3, wherein the first scan line and the second scan line are separated from each other.

7. The micro light-emitting diode driving circuit of claim 6, wherein the first data line and the second data line are connected to a junction.

8. The micro light-emitting diode driving circuit of claim 6, wherein the first data line and the second data line are separated from each other.

9. The micro light-emitting diode driving circuit of claim 1, wherein the first driving voltage source and the second driving voltage source are the same driving voltage source.

10. The micro light-emitting diode driving circuit of claim 1, wherein the first driving voltage source and the second driving voltage source are separated from each other.

11. The micro light-emitting diode driving circuit of claim 1, wherein a ratio of a channel width to a channel length of the second driving transistor is greater than a ratio of a channel width to a channel length of the first driving transistor.

12. The micro light-emitting diode driving circuit of claim 11, wherein said ratio of the channel width to the channel length of the second driving transistor is at least twice greater than said ratio of the channel width to the channel length of the first driving transistor.

13. The micro light-emitting diode driving circuit of claim 1, wherein a ratio of a channel width to a channel length of the second driving transistor is the same as a ratio of a channel width to a channel length of the first driving transistor.

14. A micro light-emitting diode display, comprising:

a substrate; and a plurality of the micro light-emitting diode driving circuits of claim 1 present on the substrate.

15. A micro light-emitting diode driving circuit in a pixel, comprising:

a micro light-emitting diode;

a first driving transistor configured to receive a first driving voltage from a first driving voltage source, and being electrically connected to the micro light-emitting diode and a low voltage source; and a second driving transistor configured to receive a second driving voltage from a second driving voltage source, and being electrically connected to the micro light-emitting diode and the low voltage source;

wherein one terminal of the first driving transistor and one terminal of the second driving transistor are electrically and separately connected to one end of the micro light-emitting diode, wherein respective drain terminals of the first driving transistor and the second driving transistor are directly connected to a cathode of the micro light-emitting diode, and a lateral length of the micro light-emitting diode is less than or equal to 50 μm.

* * * * *